US006315469B1

(12) United States Patent
Alvarez et al.

(10) Patent No.: US 6,315,469 B1
(45) Date of Patent: Nov. 13, 2001

(54) TOOL AND METHOD FOR ADJUSTMENT OF PRINTHEAD TO PLATEN SPACING IN A PRINTER

(75) Inventors: Jose Antonio Alvarez, Madrid; Rajan Ramaswamy; Emilio Angulo, both of Barcelona, all of (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/487,765

(22) Filed: Jan. 19, 2000

(51) Int. Cl.[7] ..... B41J 11/20

(52) U.S. Cl. ..... 400/59; 347/8; 400/703; 33/483; 33/732; 33/501.09

(58) Field of Search ..... 347/8, 5, 29, 30, 347/31; 400/55, 59, 703; 33/483, 732, 501.09, 501.14

(56) References Cited

U.S. PATENT DOCUMENTS

| | | | | |
|---|---|---|---|---|
| 4,607,967 | * | 8/1986 | Hirata et al. | 400/55 |
| 4,720,200 | * | 1/1988 | Gomoll et al. | 400/59 |
| 5,774,139 | * | 6/1998 | Salzer et al. | 347/32 |
| 6,027,264 | * | 2/2000 | Maher et al. | 400/55 |

* cited by examiner

*Primary Examiner*—Eugene Eickholt
(74) *Attorney, Agent, or Firm*—Skjerven Morrill MacPherson LLP; James E. Parsons; Brian D. Ogonowsky

(57) ABSTRACT

A tool and a method for adjusting a space between a printhead in a print cartridge and a platen in an ink jet printer are disclosed. The shape of the tool mimics the shape of a print cartridge. The tool is inserted into an aperture in a carriage in place of the print cartridge whose printhead is the closest to the platen, or, if all of the printheads are equally close to the platen, then the tool may be inserted in place of any of the print cartridges. The tool includes a thin flexible member that extends toward the platen. The length of the member is such that, when the tool is properly inserted into the aperture and contacts the platen, then the printhead to platen spacing at that point on the platen would be just equal to a minimum acceptable spacing between a printhead in the same aperture and the platen. Contact between the member of the tool and the platen is detected by listening for a scraping sound caused by such contact and/or watching for flexure of the member caused by such contact while moving the carriage laterally. Subsequently, the height of the carriage relative to the platen is gradually adjusted until no sound or flexure is detected as the carriage moves along the platen. Subsequently, the tool is removed and a print cartridge is inserted into the aperture so that printing may commence.

28 Claims, 7 Drawing Sheets

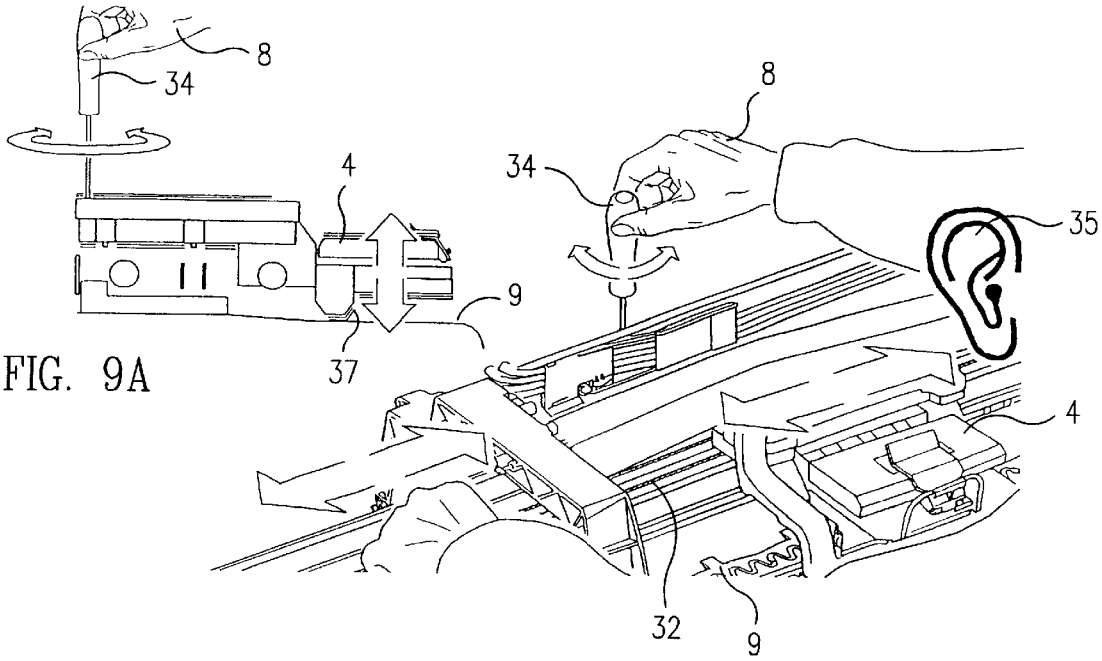
FIG. 9A
FIG. 9B
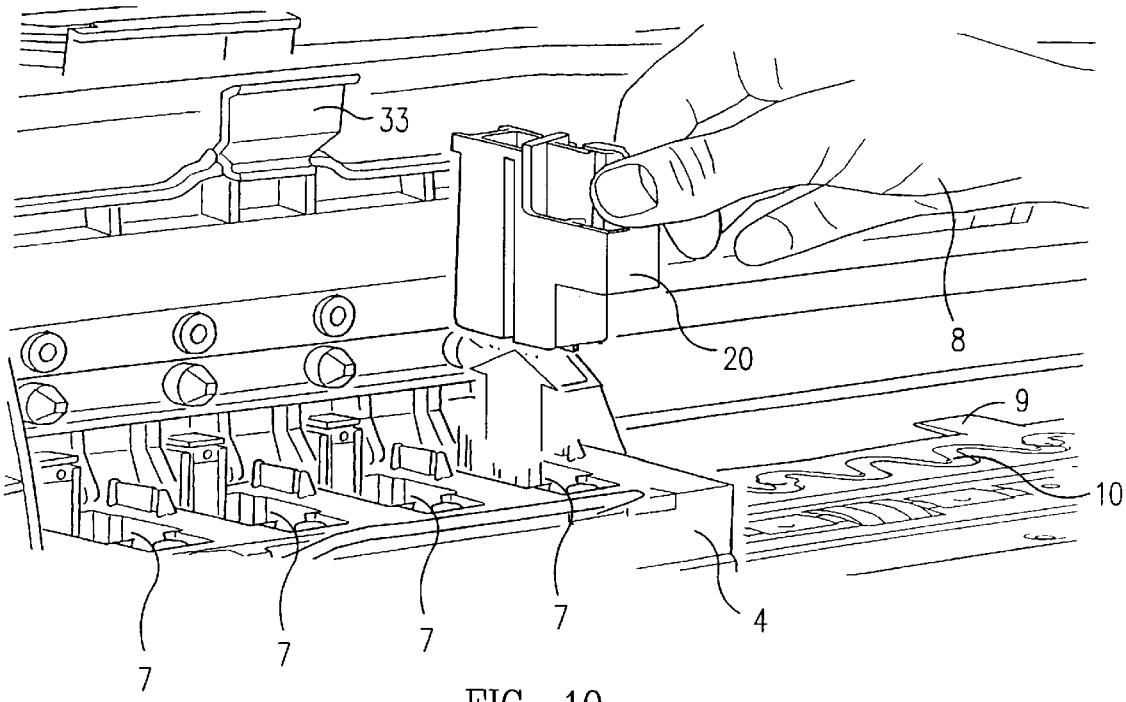
FIG. 10

TOOL AND METHOD FOR ADJUSTMENT OF PRINTHEAD TO PLATEN SPACING IN A PRINTER

FIELD OF THE INVENTION

The present invention relates to an ink jet printer, and in particular to a tool and a method for calibrating the height of a space between a printhead and a platen in an ink jet printer.

BACKGROUND OF THE INVENTION

Ink jet printers typically include a plurality of printheads supported in a moveable carriage. A platen is spaced from the printheads and supports the print media during the printing operation. A typical minimum distance between the printheads and the platen is 1.20 mm. This distance must be constant, within a tolerance, along the entire printing path of the printhead to obtain uniform printing.

Certain maintenance procedures for ink jet printers, such as carriage replacement or platen replacement, require that the printhead to platen distance be calibrated. A conventional method of calibrating the printhead to platen distance is to insert a block gauge between the platen and a part of the carriage. This method has several disadvantages. First, use of the block gauge requires that there be an accessible area for insertion of the block gauge beneath the carriage. Second, the block gauge necessarily will be displaced from the printheads, and thus there is no assurance that the spacing at the printheads will be the same as the spacing where the block gauge was inserted. Third, the technician holding the block gauge may hold the gauge at an improper angle, and thus cause errors in the calibration process. Finally, a block gauge requires that the technician feel when the gauge seizes, which also can introduce errors given the cramped area in which the tool is inserted.

Thus, there is a need for a more accurate and easier to use tool and method for calibrating the printhead to platen spacing in an ink jet printer.

SUMMARY OF THE INVENTION

The present invention improves on conventional tools and methods for calibrating the height of the space between a printhead, in a print cartridge, and the platen in an ink jet printer. A tool, in accordance with one embodiment of the present invention, has a body that mimics the shape of a print cartridge. The tool is inserted into an aperture in the carriage in the place of a print cartridge. The tool includes a member extending from the body of the tool. When the tool is inserted into the aperture, the member extends toward the platen. The length of the member is such that, when it touches the platen, the spacing between a printhead in the same aperture and the platen would be the minimum acceptable spacing for that area of the platen.

A method of calibrating the space between the printhead and the platen includes inserting the tool into an aperture in the carriage where the print cartridge normally is held during printing. The member of the tool extends toward the platen. Next, the member is made to contact the platen, if it is not initially contacting the platen, by adjusting the carriage height. Once contact is made, the carriage gradually is raised relative to the platen so that the member is as close as possible to the platen without touching. The position of the carriage relative to the platen is checked and adjusted over the entire length of the printing path by moving the carriage along the platen and listening for sound and/or watching for flexure indicative of contact between the tool's extended member and the platen. If contact is detected, the carriage is raised just enough to eliminate the contact.

These and other objects, features and advantages of the present invention will be more readily apparent from the figures and the detailed description of the exemplary embodiments set forth below.

BRIEF DESCRIPTION OF DRAWINGS

FIG. 9A is a side view of a technician raising and lowering carriage 4 relative to platen 9 in order to fine tune the printhead height around platen 9's highest point.

FIG. 9B is a perspective view of the technician of FIG. 9A raising and lowering carriage 4 relative to platen 9 while moving carriage 4 laterally along platen 9 and listening for a scraping sound.

FIG. 10 is a perspective view of a technician removing tool 20 from an aperture 7 in carriage 4.

DETAILED DESCRIPTION

Figure 1:
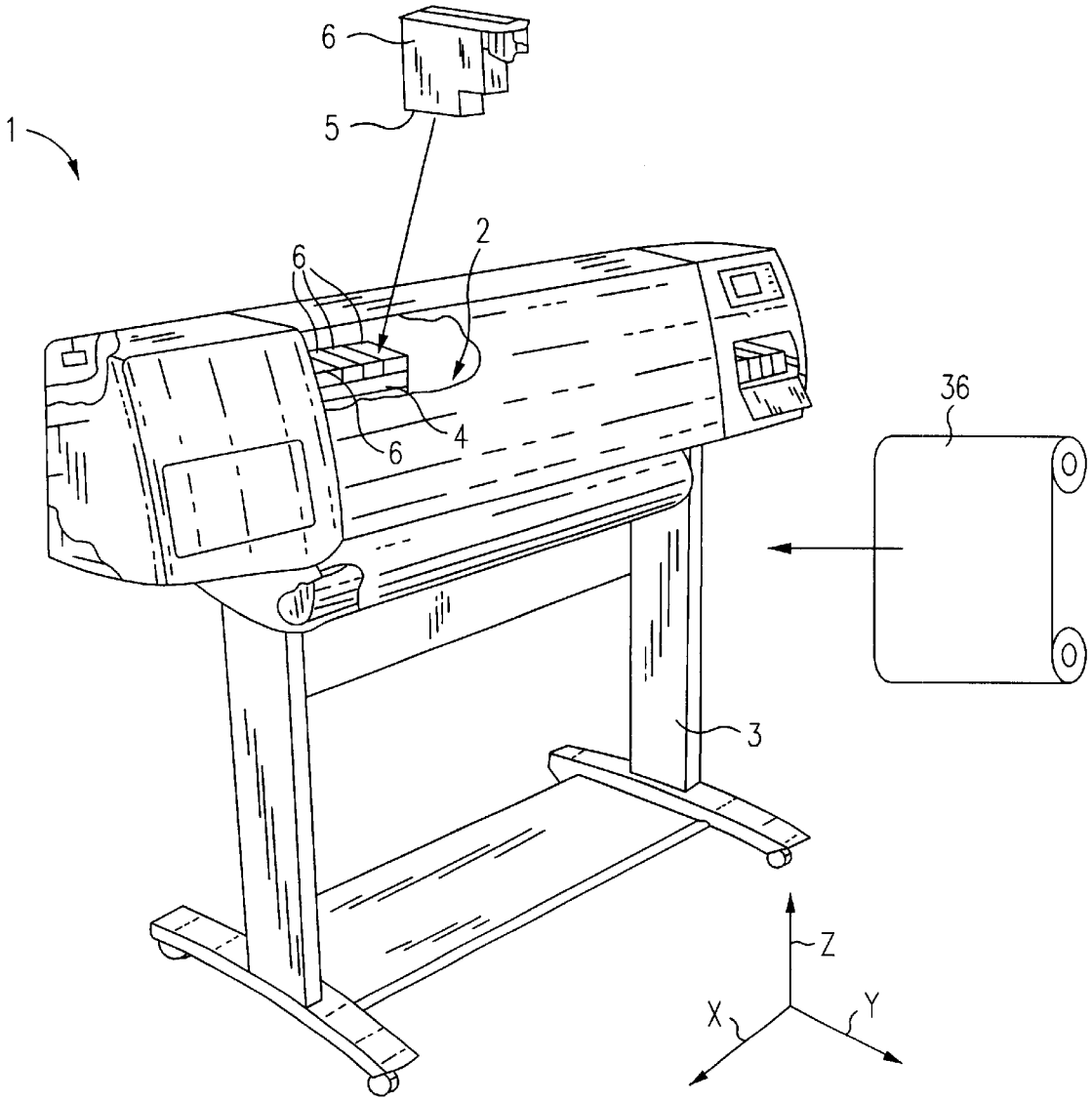
FIG. 1 is a perspective view of a printer 1 having a carriage 4 and a plurality of print cartridges 6, each of which includes a printhead 5.

FIG. 1 shows a printer 1 having an internal chassis 2 supported by a pair of spaced legs 3. Printer 1 includes four print cartridges 6 mounted on a moveable carriage 4. Each print cartridge 6 includes a printhead 5 at a lower surface of the print cartridge. One printhead 5 prints black ink, and the other printheads 5 print color ink. A print media 36 (e.g., paper or film) is fed into printer 1. Ink is ejected by printheads 5 onto print media 36 according to information input into printer 1.

Figure 2:
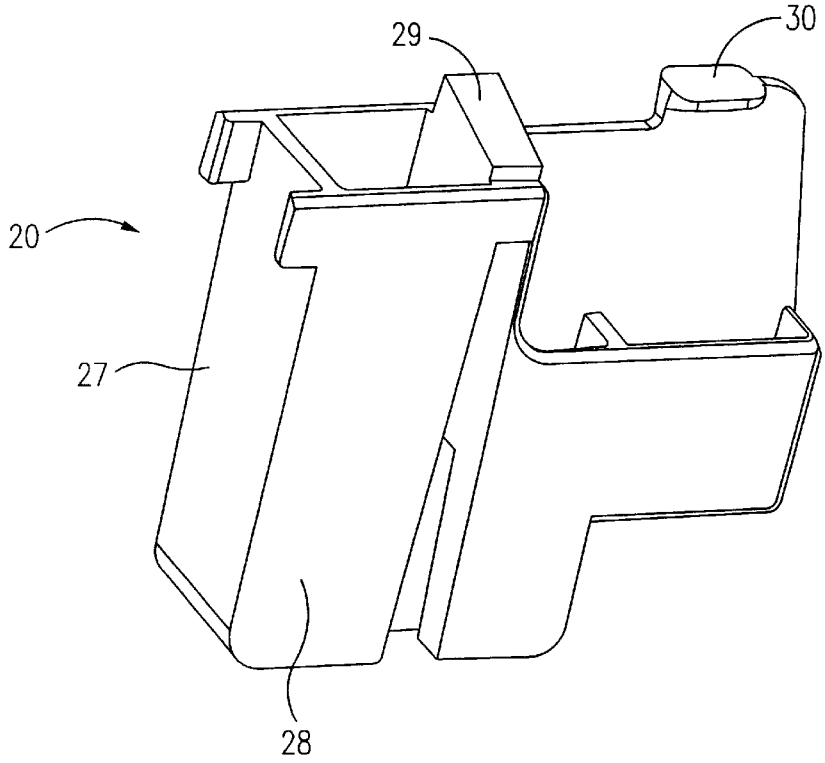
FIG. 2 is a perspective view of a tool 20 for calibrating the height of a space between a printhead and a platen of printer 1.
Figure 3:
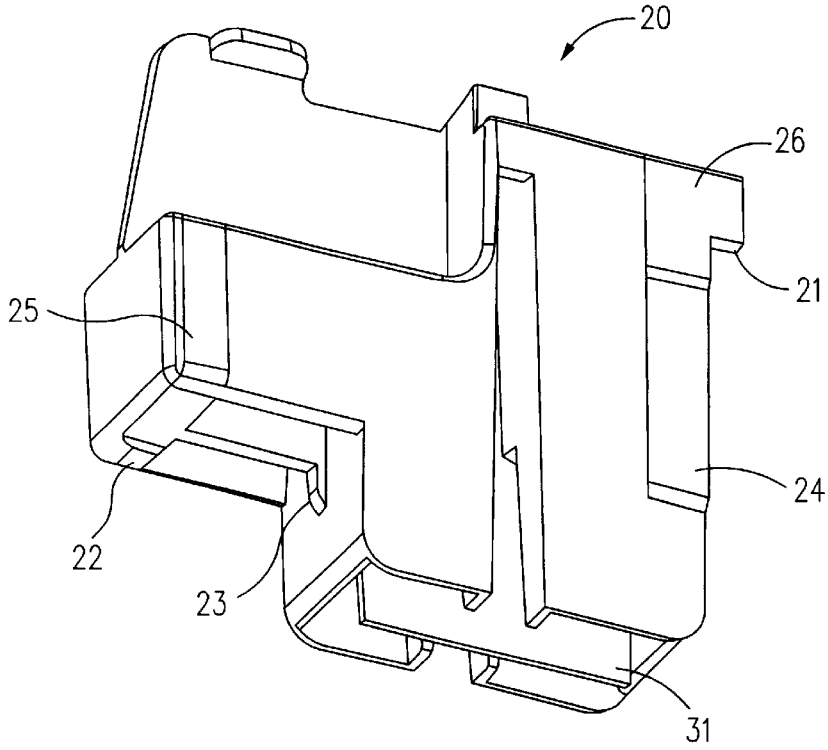
FIG. 3 is a second perspective view of tool 20 of FIG. 2.

FIGS. 2 and 3 are alternate perspective views of a tool 20 formed of a molded plastic material. Tool 20 is used to calibrate the printhead to platen spacing in printer 1 of FIG. 1, although tool 20 and variations thereof are generally applicable to a variety of ink jet printers. Tool 20 is used by inserting tool 20 into an aperture in carriage 4 where a print cartridge 6 is normally held during printing. Accordingly, the body of tool 20 is shaped similarly to a print cartridge 6.

Figure 4:
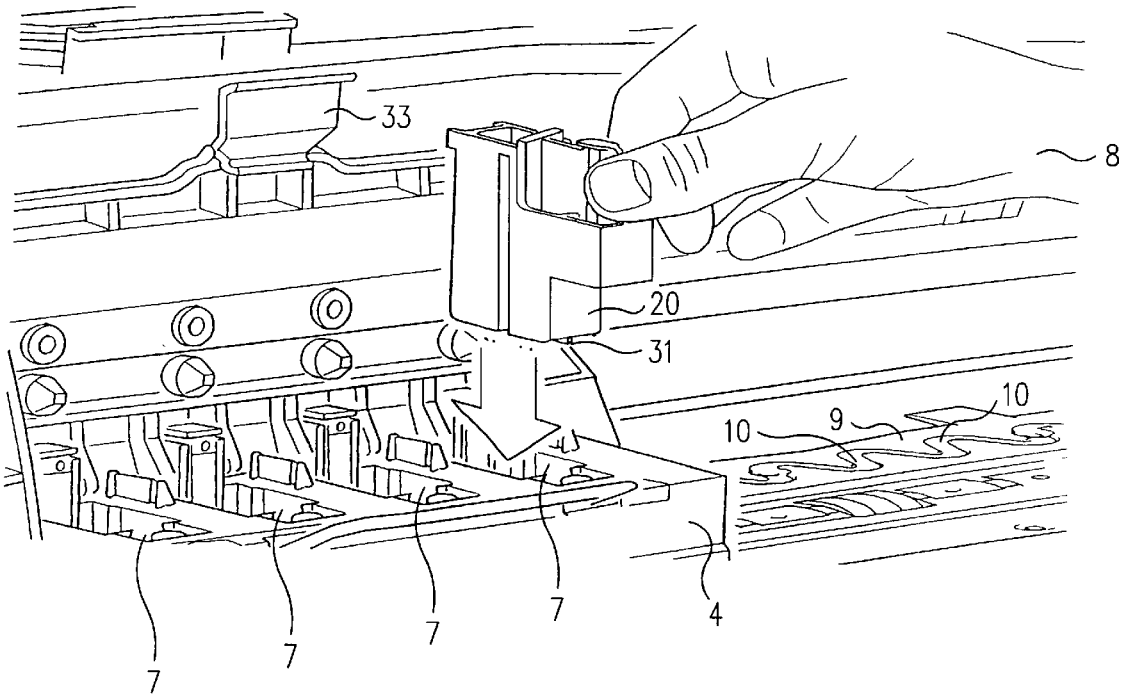
FIG. 4 is a perspective view of a technician inserting tool 20 of FIGS. 2 and 3 into an aperture 7 in carriage 4 of printer 1 of FIG. 1.

FIG. 4 is a perspective view of a hand 8 inserting tool 20 into the rightmost aperture 7 of carriage 4. Carriage cover 33 is raised to permit access to apertures 7. Carriage 4 includes four print cartridge apertures 7. The rightmost aperture 7 is for the black ink print cartridge 6 and its associated printhead 5. The other three apertures 7 are for color ink print cartridges.

For the sake of example, the black ink printhead 5 is defined to be closer to platen 9, for example, 0.1 mm closer, than the color printheads 5. Accordingly, the printhead to platen spacing of the black ink printhead 5 will be calibrated using tool 20, although the printhead to platen spacing of the color printheads 5 can be calibrated using a similar tool and method. In an alternative embodiment of a printer (not shown), where the printhead to platen spacing of all of the printheads is the same, then tool 20 could be inserted into carriage 4 in the place of any of the print cartridges 6.

In FIG. 4, platen 9 is below carriage 4 and printheads 5 (not shown). Platen 9 has grooves 10 for proper accommodation of the print media that advances on platen 9. The vacuum keeps the print media in place as the print media advances.

Figure 11:
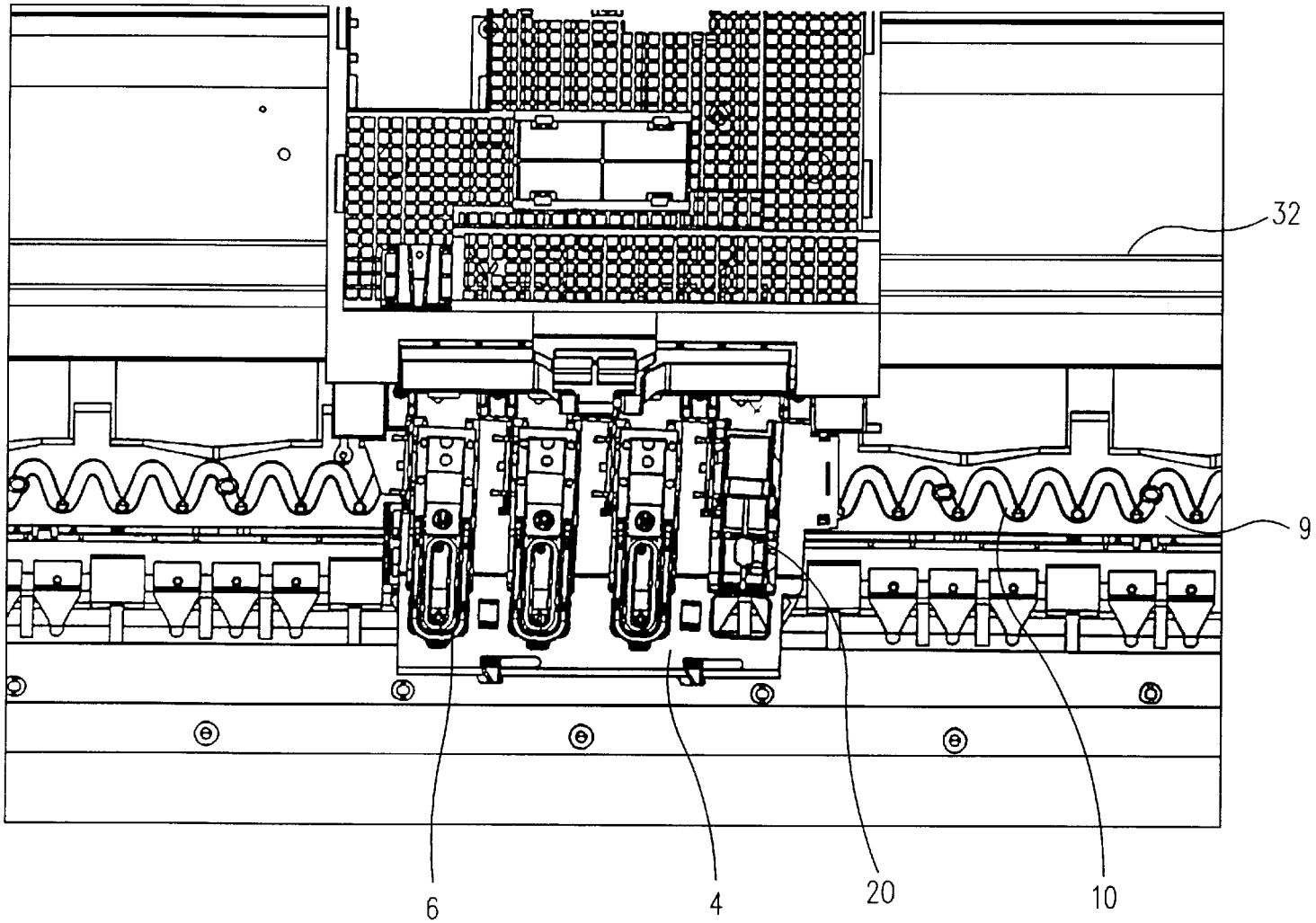
FIG. 11 is a top plan view of carriage 4, platen 9, and tool 20.

FIG. 11 is a top plan view of carriage 4. Platen 9 and grooves 10 are beneath carriage 4. Tool 20 is inserted in an aperture 7.

Returning to FIGS. 2 and 3, tool 20 includes surfaces that mimic the surfaces of a print cartridge 6. For example, tool 20 includes six surfaces 21, 22, 23, 24, 25, and 26 that mimic print cartridge surfaces that contact precisely machined datum points of aperture 7. Precise contact between surfaces 21–26 and the datum surfaces of aperture 7 ensures that tool 20 is precisely located in aperture 7 and carriage 4, just as a print cartridge 6 would be precisely located. In addition, tool 20 includes compression surfaces 27, 28, and 29 where carriage 4 applies force to keep tool 20 in place. Surfaces 27–29 mimic compression surfaces on the print cartridge 6. Tool 20 also includes a handle 30 for inserting and removing tool 20 from aperture 7 of carriage 4.

Figure 5:
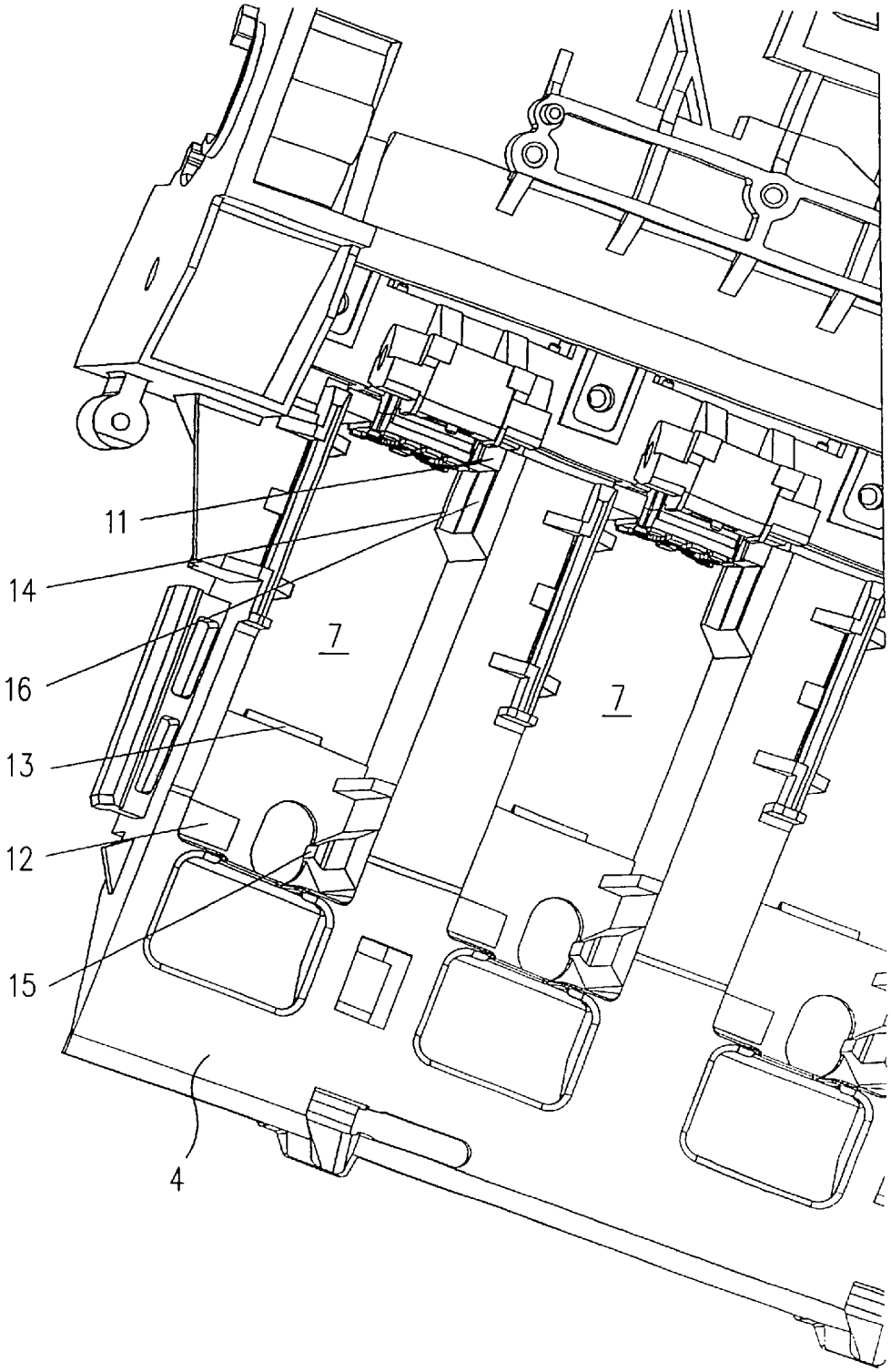
FIG. 5 is a perspective view of an aperture 7 in carriage 4 of FIG. 4.

FIG. 5 is a perspective view of an aperture 7 of carriage 4. Carriage surfaces 11, 12, 13, 14, 15 and 16 within aperture 7 contact surfaces 21, 22, 23, 24, 25, and 26, respectively, of tool 20 when tool 20 is inserted into aperture 7.

Referring to FIGS. 3 and 4, tool 20 also includes a flexible member 31 that extends from a first end that is connected to the body of tool 20 to an exposed second end that extends from the body of tool 20. The length of member 31 beyond the body of tool 20 is such that, when member 31 touches platen 9 (after tool 20 is properly inserted into aperture 7 of carriage 4), the printhead to platen spacing for a printhead in the same aperture would be equal to the minimum acceptable printhead spacing for that particular point along platen 9. Accordingly, the length of member 31 can vary depending, for example, on the printer being calibrated. As an example, tool 20 can be used to calibrate the printhead to platen spacing of the DESIGN JET 1050C and 1055CM model printers from the Hewlett Packard Company. For such printers, member 31 may have: (1) a total length of 19.00 mm from a first end connected to an internal portion of the body of tool 20 to an opposite end extending beyond the body; (2) a length of 1.00 mm beyond the body of tool 20; (3) a width of 0.8 mm and a length of 24.90 mm (paper axis direction) at its tip; and (4) a molding taper of 0.05 degrees. The length of the exposed tip of member 31 is about equal to the printing width of the printhead on the platen and is slightly larger than the platen grooves.

As shown in FIG. 4, a method of using tool 20 to calibrate the spacing between a printhead 5 (not shown) and platen 9 of printer 1 includes inserting tool 20 into an aperture 7 of carriage 4. In this example, tool 20 is inserted into the right-most aperture 7, which holds the black ink print cartridge 6 during printing. In this particular example, the black ink printhead 5 was chosen for height adjustment because the black ink printhead 5 was defined as being the closest to platen 9.

Artisans will appreciate that ordinary preparation steps, such as removing or raising covers or sensors or other portions of printer 1 that block access to carriage 4, as well as removing the black ink print cartridge 6, must be taken prior to inserting tool 20. In addition, since the calibration method requires raising and lowering carriage 4 relative to platen 9, any fasteners that hold carriage 4 in place must be loosened. In the DESIGN JET 1050C and 1055CM model printers from the Hewlett Packard Company, for example, the T10 screws at the rear of the carriage must be loosened (but not fully removed).

Figure 6:
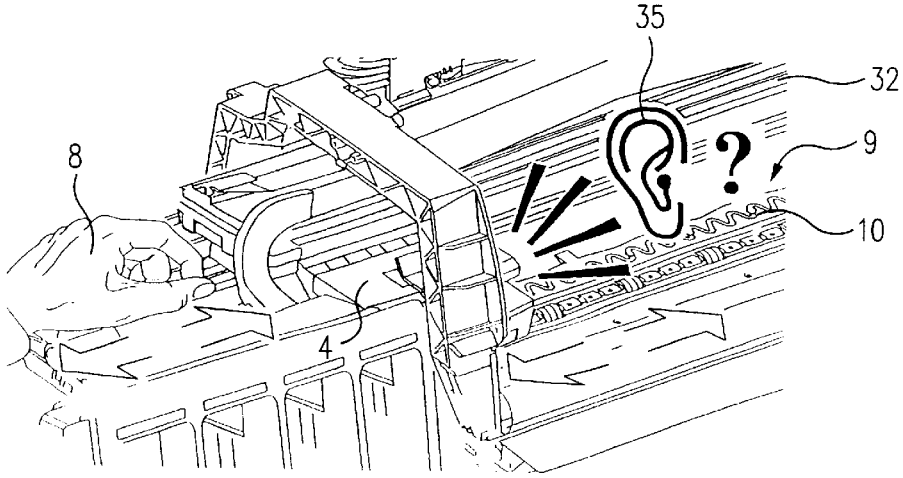
FIG. 6 is a perspective view of a technician moving carriage 4 along platen 9 and listening for a scraping sound caused by tool 20.

After tool 20 is inserted in carriage 4, carriage cover 33 is closed. In addition, carriage 4 is moved to the left side of the printer. FIG. 6 shows carriage 4 at the left side of printer 1. Next, carriage 4 is moved laterally along the length of platen 9 by pulling on the belt 32 that moves carriage 4. The technician listens for a scraping sound while moving carriage 4. The listening is represented by ear 35. The scraping sound is caused by member 31 of tool 20 scraping against grooves 10 of platen 9 as carriage 4 is moved along platen 9. Most of member 31 is within an internal cavity of tool 20 which may amplify sound created by the scraping of the tip of member 31 against platen 9. Alternatively, instead of listening for a scraping sound, or in combination with listening for a scraping sound, the technician can watch for a flexing of member 31 as member 31 contacts platen 9. If a scraping sound and/or flexure is detected, then the technician moves to the next step.

If no scraping sound or flexure of member 31 is detected when carriage 4 is moved along platen 9, then carriage 4 must be lowered until member 31 of tool 20 contacts platen 9 and thereby causes a scraping sound or flexure. In the DESIGN JET 1050C and 1055CM model printers from the Hewlett Packard Company, for example, the T9 screw is turned counterclockwise to lower carriage 4 relative to platen 9, and clockwise to raise carriage 4.

Figure 7A:
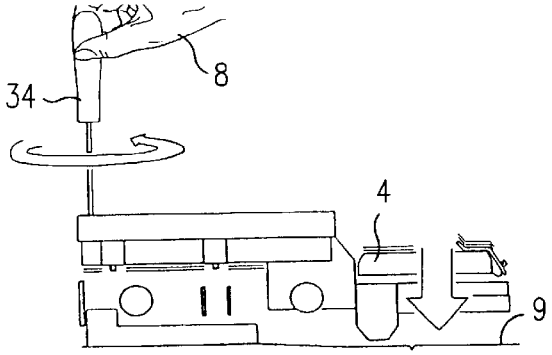
FIG. 7A is a side view of a technician lowering carriage 4 relative to platen 9 so as to contact the adjustment tool against platen 9.
Figure 7B:
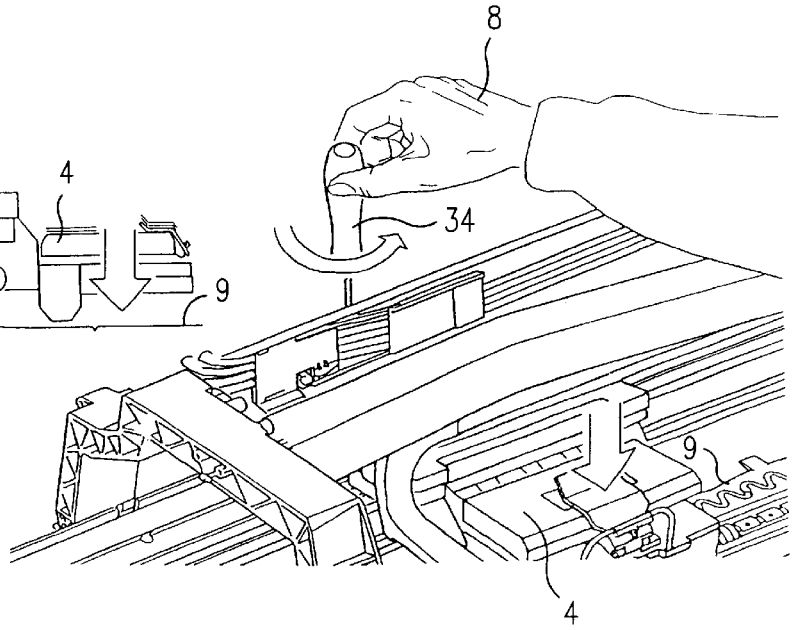
FIG. 7B is a perspective view of the technician of FIG. 7A lowering carriage 4.

FIGS. 7A and 7B show the lowering of carriage 4 relative to platen 9 so that member 31 of tool 20 comes in contact with platen 9. FIG. 7A is a perspective side view of a hand 8 lowering carriage 4 by turning an adjustment screw (not shown) counterclockwise with a screwdriver 34. FIG. 7B is an alternate perspective view of hand 8 lowering carriage 4. Once carriage 4 is lowered, the steps of moving carriage 4 along platen 9 and listening for a scraping sound (see FIG. 6) and/or watching for flexure of member 31 are repeated until contact is established.

Figure 8A:
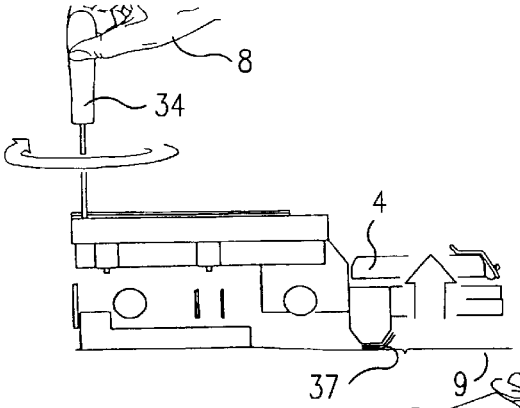
FIG. 8A is a side view of a technician raising carriage 4 relative to platen 9 so that the adjustment tool gradually loses contact with a juxtaposed portion of platen 9.
Figure 8B:
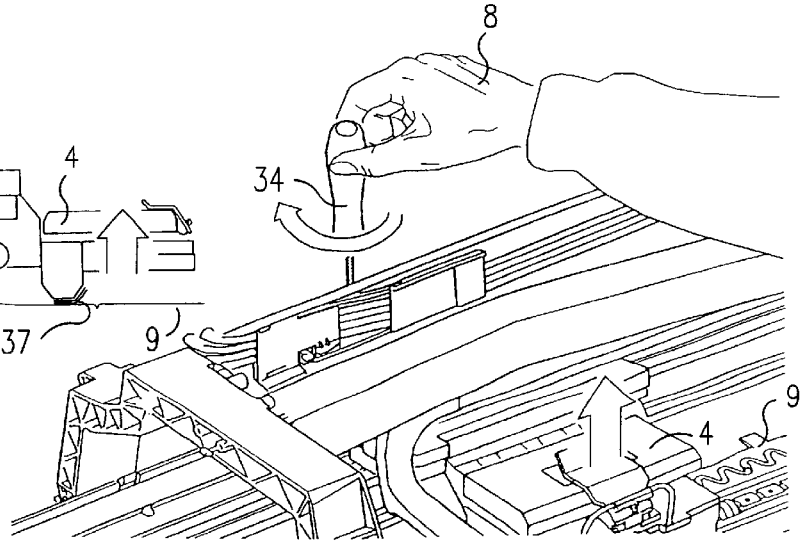
FIG. 8B is a perspective view of the technician of FIG. 8A raising carriage 4.

The next step is to raise carriage 4 a minimum amount so that member 31 of tool 20 does not contact platen 9 as carriage 4 is moved laterally along platen 9. FIGS. 8A and 8B show the raising of carriage 4 relative to platen 9 by clockwise rotation of an adjustment screw (not shown). Raising carriage 4 creates a small space 37 between member 31 of tool 20 and platen 9.

Subsequently, the technician begins an iterative process to minimize space 37 between member 31 of tool 20 and platen 9 along the length of platen 9. This iterative process involves raising and lowering carriage 4 by rotating the carriage adjustment screw and moving carriage 4 back and forth along the length of platen 9. FIGS. 9A and 9B show this iterative process of rotating the adjustment screw (not shown) with screwdriver 34 while moving carriage 4 laterally and listening for a scraping sound. The adjustment process is complete when member 31 of tool 20 is as close as possible to platen 9 without causing a scraping sound or flexure of member 31 as carriage 4 is moved along platen 9.

When member 31 is as close as possible to platen 9 without touching, the position of carriage 4 is secured. In the DESIGN JET 1050C and 1055CM model printers, carriage 4 is secured by tightening the T10 screws at the rear of the carriage. Finally, tool 20 is removed from aperture 7 of carriage 4 (see FIG. 10), the black ink print cartridge 6 and printhead 5 are inserted into aperture 7, and carriage cover 33 is closed.

After the printhead to platen spacing is adjusted using tool 20 and print cartridges 6 are placed in carriage 4, a printing method includes feeding a print media, such as print media 36 of FIG. 1, through the calibrated space between printheads 5 and platen 9. Ink is ejected from printheads 5 onto the print media as carriage 4 moves printheads 5 along platen 9 according to information input from, for example, a computer (not shown) connected to printer 1.

The embodiments described herein are merely examples of the present invention. Artisans will appreciate that variations are possible within the scope of the claims.

What is claimed is:

1. In a printer having a carriage and a platen, wherein the carriage includes an aperture for insertion of a print cartridge having a printhead, a tool for calibrating a space between the printhead and the platen, said tool comprising:

a body insertable into the aperture;

a member extending from said body such that, when the body is inserted into the aperture, the member extends toward the platen of the printer.

2. The tool of claim 1, wherein the member is flexible.

3. The tool of claim 1, wherein the member has a length such that, when the tool is inserted into the aperture and contacts the platen, the height of a space between a printhead in the same aperture and the platen would be a minimum acceptable spacing.

4. The tool of claim 1, wherein the tool is formed of a plastic material.

5. The tool of claim 1, wherein the body of the tool includes a central cavity having an open first side, and said member extends from a first end within the cavity and integral with said body through the cavity to a second end extending beyond said open first side.

6. The tool of claim 1, wherein the tool has a capability of making a sound when inserted into the aperture and the member is made to contact the platen as the carriage is moved laterally.

7. The tool of claim 1, wherein the member has a capability of flexing when the tool is inserted into the aperture and the member is made to contact the platen as the carriage is moved laterally.

8. In a printer having a carriage and a platen, wherein the carriage includes an aperture for insertion of a print cartridge having a printhead, a method comprising:

providing a tool insertable into the aperture;

inserting the tool into the aperture; and adjusting a position of the carriage relative to the platen using the tool.

9. The method of claim 8, wherein said tool comprises a body insertable into the aperture and a member extending from said body;

wherein said tool is inserted into the aperture so that the member extends toward the platen; and wherein the position of the carriage relative to the platen is adjusted using the member of the tool.

10. The method of claim 9, further comprising removing a print cartridge from the aperture prior to inserting the tool into the aperture;

removing the tool from the aperture after adjusting the position of the carriage relative to the platen; and inserting the print cartridge into the aperture after removing the tool.

11. The method of claim 9, wherein calibrating a position of the carriage relative to the platen comprises contacting the member against the platen.

12. The method of claim 11, further comprising creating a space between the member and the platen after contacting the member against the platen.

13. The method of claim 12, wherein creating the space between the member and the platen includes raising the carriage relative to the platen.

14. The method of claim 8, further comprising moving the carriage laterally after the tool is inserted.

15. The method of claim 14, further comprising listening for sound caused by contact between the member and the platen while moving the carriage laterally.

16. The method of claim 14, further comprising watching for flexure of the member caused by contact between the member and the platen while moving the carriage laterally.

17. The method of claim 8, further comprising using sound to adjust the position of the carriage relative to the platen.

18. The method of claim 8, further comprising using visible flexure of the member to adjust the position of the carriage relative to the platen.

19. The method of claim 8, wherein the carriage includes a plurality of apertures for print cartridges each having a printhead, and further comprising inserting the tool into an aperture for a print cartridge whose printhead is closer to the platen than the printhead of the one or more other print cartridges.

20. In a printer having a carriage and a platen, wherein the carriage includes an aperture for insertion of a print cartridge having a printhead, a method of printing comprising:

providing a tool insertable into the aperture;

inserting the tool into the aperture;

adjusting a position of the carriage relative to the platen using the tool;

removing the tool from the aperture;

inserting a print cartridge having a printhead into the aperture, wherein a space is between the printhead and the platen;

feeding a print media through the space; and ejecting ink from the printhead onto the print media.

21. The method of claim 20, wherein said tool comprises a body insertable into the aperture and a member extending from said body;

wherein said tool is inserted into the aperture so that the member extends toward the platen; and wherein the position of the carriage relative to the platen is adjusted using the member of the tool.

22. The method of claim 21, wherein adjusting the position of the carriage relative to the platen comprises contacting the member against the platen.

23. The method of claim 22, further comprising creating a space between the member and the platen after contacting the member against the platen.

24. The method of claim 20, further comprising moving the carriage laterally after the tool is inserted.

25. The method of claim 24, further comprising listening for sound caused by contact between the member and the platen while moving the carriage laterally.

26. The method of claim 24, further comprising watching for flexure of the member caused by contact between the member and the platen while moving the carriage laterally.

27. The method of claim 20, further comprising using sound caused by the tool or visible flexure of the tool to adjust the position of the carriage relative to the platen.

28. The method of claim 20, wherein the carriage includes a plurality of apertures for print cartridges each having a printhead, and further comprising inserting the tool into an aperture for a print cartridge whose printhead is closer to the platen than the printhead of the one or more other print cartridges.

* * * * *